US005085474A

United States Patent [19]

Toledo et al.

[11] Patent Number: 5,085,474

[45] Date of Patent: Feb. 4, 1992

[54] REVERSIBLE DOOR LATCH OPENER

[75] Inventors: George F. Toledo, Fall Brook; John E. Betts, Garden Grove, both of Calif.

[73] Assignee: Thomas Industries Inc., Los Angeles, Calif.

[21] Appl. No.: 566,776

[22] Filed: Aug. 14, 1990

[51] Int. Cl.[5] ..... E05C 15/20

[52] U.S. Cl. ..... 292/92; 292/336.3; 292/244

[58] Field of Search ..... 242/336.3, 244, 245, 242/DIG. 65, 21, 92; 70/92

[56] References Cited

U.S. PATENT DOCUMENTS

| | | | |
|---|---|---|---|
| 983,011 | 1/1911 | Voight | 292/21 |
| 1,345,041 | 6/1920 | Voight | 292/21 |
| 1,539,350 | 5/1925 | Clark | 292/21 |
| 2,910,857 | 11/1959 | Muessel | 292/92 |
| 3,477,754 | 11/1969 | Check . | |
| 3,869,159 | 3/1975 | Eads | 292/92 |
| 4,003,593 | 1/1977 | Wilzig et al. . | |
| 4,007,954 | 2/1977 | Erickson . | |
| 4,988,136 | 1/1991 | Gressett, Jr. | 292/244 |

*Primary Examiner*—Eric K. Nicholson

*Attorney, Agent, or Firm*—Hill, Van Santen, Steadman & Simpson

[57] ABSTRACT

A door latch opener having a reversible mounting plate, a handle reversibly mounted on the mounting plate, an actuator reversibly mounted on the mounting plate and a spring reversibly mounted between the mounting plate and the handle permitting reconfiguration of the door latch opener allowing its operation in a wide variety of orientations. The door latch opener can be used with the handle in an upward or downward position and by pulling or pushing on the handle. Two such door openers can be used on a door in a cooperating non-interfering arrangement in various combinations of configurations.

20 Claims, 3 Drawing Sheets

REVERSIBLE DOOR LATCH OPENER

BACKGROUND OF THE INVENTION

The present invention relates to door latch openers and more particularly to a door latch opener which can be used in a reversed position.

Door latch openers are known mechanisms for operating a latch bolt to move the latch bolt in and out of engagement with a striker plate to selectively lock and unlock a door. For example, in U.S. Pat. No. 4,003,593 there is disclosed a door latch opener having a handle mounted on a base plate to pivot about a first axis and with a bell crank actuator mounted on the base plate to pivot about a second axis perpendicular to the first axis. The handle has a projection engageable with the actuator when the handle is pivotally moved. In that patent the latch bolt mechanism would be disengaged from the striker when the handle is pushed downwardly against the bias of a spring.

In some circumstances it is desirable to have a handle which unlocks the door by pushing on the handle and in other circumstances it is desirable to have the handle unlock the door when the handle is pulled. Also, in some circumstances it is desirable to unlock the door by operating on a handle which depends downwardly and in other circumstances it is desirable to unlock the door by engaging a handle which extends upwardly. Also, a separate door latch opener is required on each side of the door and both openers must cooperate without interference with the other to engage a single latch bolt.

In presently available door latch openers, different openers are required to satisfy each of the different operating orientations. Thus, a much larger inventory of parts and final assemblies is required to satisfy all of the different operating orientations than if a single assembly were available which could provide the necessary opening functions in the various described orientations.

SUMMARY OF THE INVENTION

The present invention provides a door latch opener which can be configured to unlock a door with either a pushing operation or a pulling operation and with the handle depending downwardly or extending upwardly. Also, the door latch openers may be used on both the inside of the door and the outside of the door and with the door swinging in a right hand manner or a left hand manner in cooperating relationship regardless of the orientation of the opposite door latch opener. Thus, a single door latch opener of the push-pull type is provided which will function in any operating configuration.

To accommodate the varying positions, a base plate is provided to which the handle and an actuator are mounted. The handle is mounted on the base plate to pivot about a first axis. The actuator is mounted on the base plate to pivot about a second axis perpendicular to the first axis. The handle has oppositely extending projections, a first of the projections being engageable with the actuator when the handle is pivotally mounted in a first orientation and a second of the projections being engageable with the actuator when the handle is pivotally mounted in a second, opposite orientation. The handle pivot may be selectively movable into two different positions spaced parallel to the second axis to accommodate the different orientations and to allow for cooperation with another door latch opener. The actuator may be reversely mounted to the base plate to provide opposite movements of the actuator. The base plate may be reversely mounted to the door to provide opposite movements of the handle and the actuator.

DETAILED DESCRIPTION OF THE PREFERRED EMBODIMENTS

Figure 1:
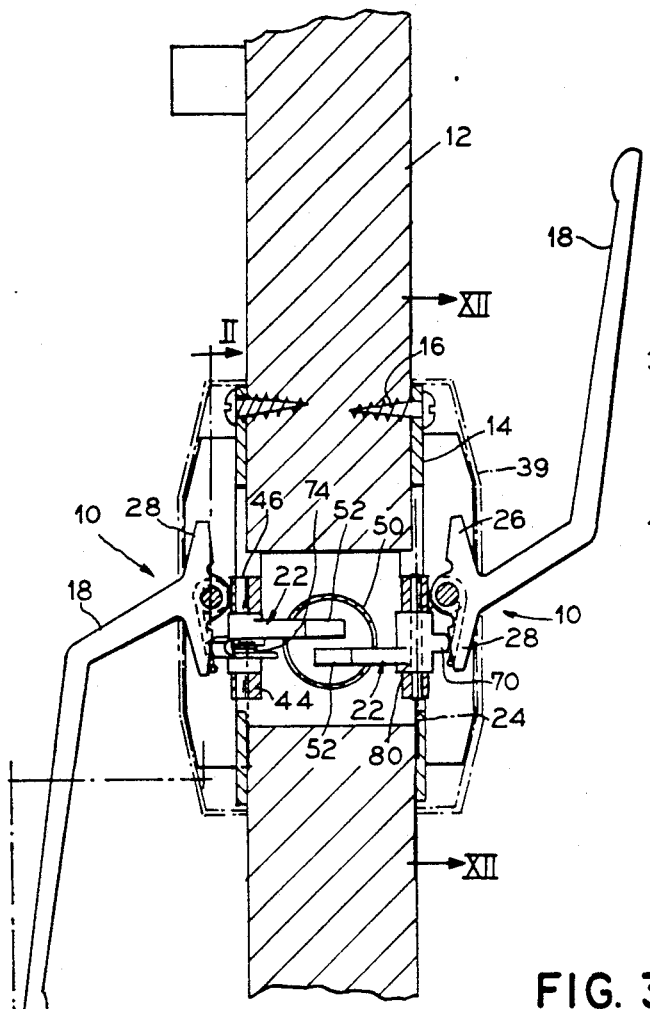
FIG. 1 is a side sectional view through a door illustrating two opposed and cooperating door latch openers embodying the principles of the present invention.
Figure 2:
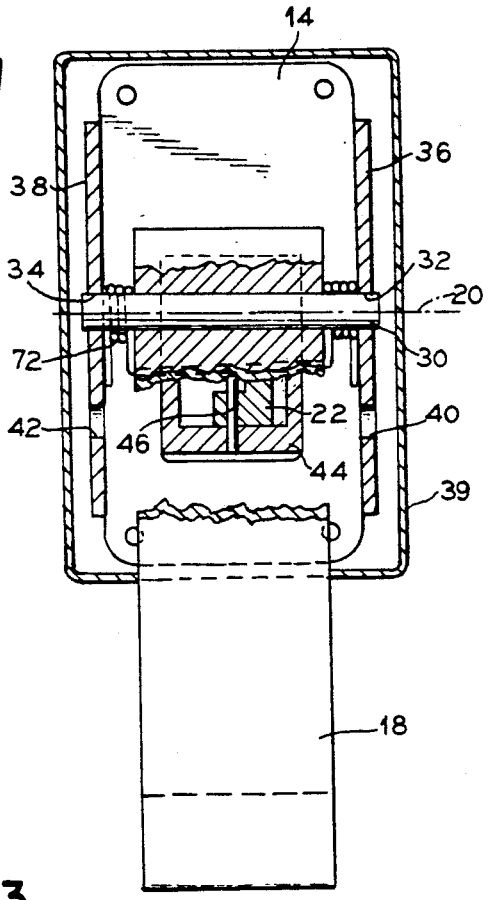
FIG. 2 is a sectional view through the door latch opener taken generally along the lines II—II of FIG. 1.

In FIG. 1 there are illustrated two door latch openers 10 mounted to opposite sides of a door 12. Each of the door latch openers is comprised of identical components, however some of the components are reversed as will be described in detail below. Each of the door latch openers includes a base plate 14 which is secured to the door 12 by appropriate fasteners such as screws 16. A handle 18 is mounted on the base plate 14 to pivot about a first axis 20. An actuator 22 is mounted on the base plate 14 to pivot about a second axis 24 perpendicular to the first axis 20.

The handle 18 has oppositely extending projections 26, 28 which extend generally parallel to the second axis 24. The first projection 26 is engageable with the actuator 22 when the handle 18 is pivotally mounted in the first orientation, such as that shown on the left hand side of FIG. 1 and the second projection 28 is engageable with the actuator 22 when the handle is pivotally mounted in a second orientation such as that shown on the right hand side of FIG. 1.

Figure 12:
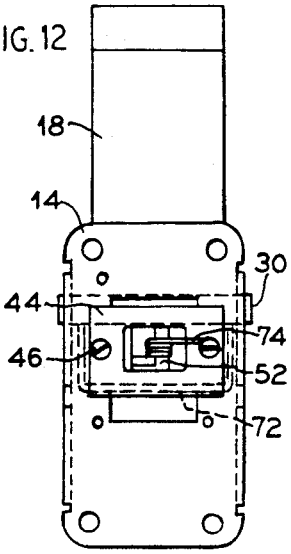
FIGS. 12–23 are elevational views of the door latch opener mechanism taken generally along the line XII—XII of FIG. 1 and showing the orientations of the handles and actuators to accommodate the various handle positions illustrated in FIGS. 4–11.
Figure 13:
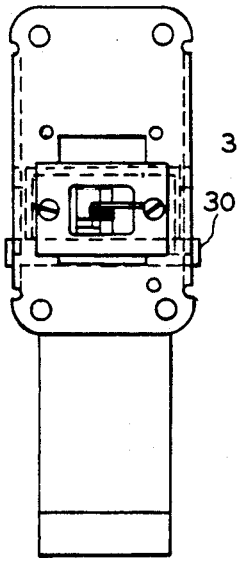
Figure 14:
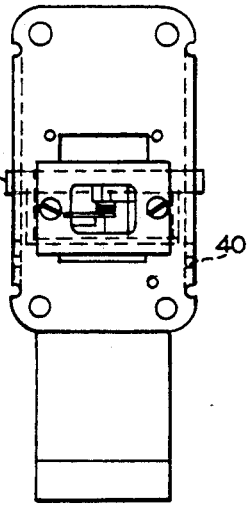
Figure 15:
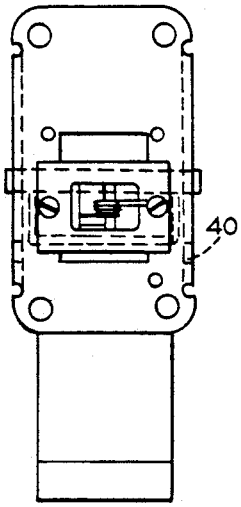
Figure 16:
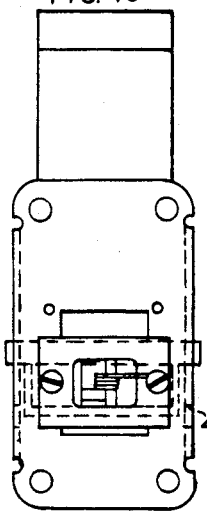

The handle 18 is pivotally mounted to the base plate 14 by means of a pivot pin 30 extending through aligned centered openings 32, 34 in upstanding walls 36, 38 of the base plate 14. A second pair of aligned openings 40, 42, spaced from aligned openings 32, 34 in a direction parallel to the second axis, is provided to permit cooperation and prevent interference between opposing door latch openers as is necessary. Since the pivot pin 30 is removable, the handles 18 can be removed from the mounting plate 14 and reversed. That is, a downwardly depending handle as shown in the left hand side of FIG. 1 can be rotated 180° to be an upwardly directed handle as shown on the right hand side of FIG. 1. This is accomplished simply by removing pivot pin 30, reversing the orientation of the handle and replacing the pivot pin. The actuator 22 is carried on a removable pivot plate 44 which receives a pivot pin 46 pivotally carrying the actuator 22. The pivot plate 44 is secured to the mounting plate 14 by appropriate fastening devices 46 such as screws (FIG. 12).

Figure 3:
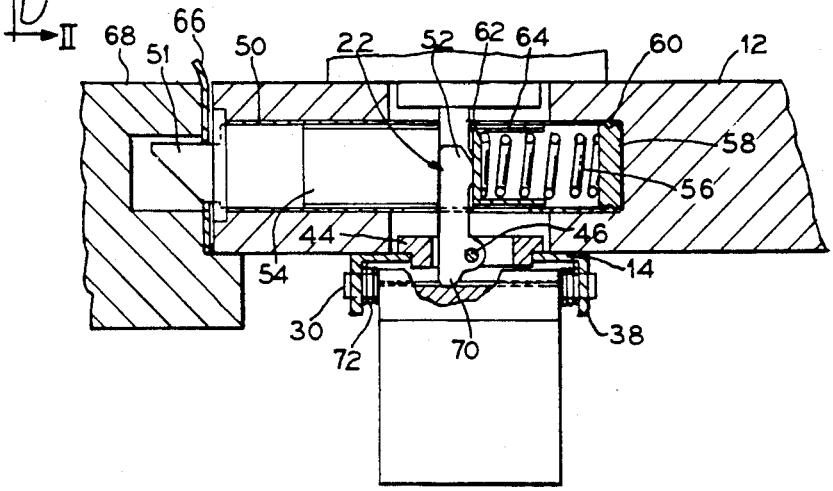
FIG. 3 is a top sectional view through the door showing the latch bolt mechanism and engagement with a striker plate.

FIG. 3 illustrates a latch bolt housing 50 which is carried in the door 12 and which houses a latch bolt 51 which is reciprocably sildable in the door 12. The actuator 22 includes a projecting arm 52 which is engageable in an opening 54 in the latch bolt housing 50 such that the arm 52 will engage with a portion of the latch bolt 51 causing the latch bolt to slide in a reciprocating manner upon operation of the handle mechanism.

Positioned within the latch bolt housing 50 is a biasing means 56 in the form of a coil spring which presses against a cap 58 secured to the housing 50 by appropriate means, such as crimp connection 60. An opposite end of the spring 56 presses against a cylindrical member 62 which is secured to the latch bolt 51 by appropriate fastening means such as a crimp connection 64. The spring 56 is sized so as to continuously bias the latch bolt 51 into a position protruding out of the door 12. In such a position the cylindrical member 62 will be exposed through the opening 54 in the housing 50. The arm 52 of the actuator 22 will press against the cylindrical member 62 in order to overcome the bias of the spring 56 to retract the latch bolt 51 into the door and out of locking engagement with a striker plate 66 which is secured to a door jam 68.

The actuating member 22 has a short arm 70 extending opposite that of arm 52 which is engageable by one of the projections 26, 28 of the handle 18. The pivot pin 46 is carried off centered in the actuator 22 such that a pressing against the second arm 70 will cause rotation of the actuator 22. For example, in the orientation shown in FIG. 3, a pressing against the second arm 70 of the actuator 22 will cause rotation of the actuator in a clockwise direction, thus retracting the latch bolt 51 as desired.

Biasing means 72, in the form of a coil spring engages between one of the projections 26, 28 and the mounting plate 14 to continuously urge the projecting portion 26, 28 associated with the actuator 22 away from the actuator. A separate biasing means 74 in the form of a coil spring continuously biases the actuator 22 so that the second end 70 is moved toward the associated projecting member 26, 28. Thus, when operating pressure on the handle 18 is released, the handle will return to a position in which the latch bolt 51 is in a projecting, locking position.

As seen in FIG. 1, the first arms 52 of the actuators 22 extend toward one another into the opening 54 within the latch bolt housing 50. The actuator 22 has a central body portion 80 which receives the pivot pin 46 and which has a height or thickness much greater than that of the arms 52, 70. The arm 70 is located approximately midway along the height of the body portion 80 while the arm 52 is considerably offset from the midpoint. In this manner, when the opposing door latch mechanisms are assembled onto a door, the actuators will be vertically offset from one another so as to cooperate within the latch bolt mechanism without interference. The actuators 22 and their mounting pivot plate 44 are removably secured to the mounting plate 14 such that they may be reversed in order to accommodate varying orientations and provide opposite pivoting movement as described below. In some orientations when the handles are oriented in the same vertical direction, the actuator arms 52 would interfere with one another if only a single location for the handle pivot pin 30 were provided. In those instances, the handle pivot pin 30 can be moved to the second pair of aligned openings 40, 42.

To further understand the invention, FIGS. 4–11 illustrate the various combinations of door handle orientations and operating characteristics which are accommodated by the single door latch opener of the present invention. Each of the handle orientations is illustrated in FIGS. 12–23 showing the particular placement of the handle 18 and actuator 22 to accommodate the desired function of the door latch opener and to cooperate with the opposing door latch opener orientation.

Figure 4:
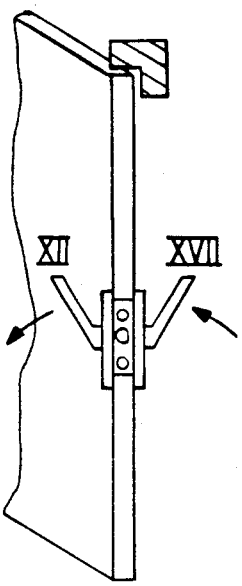
FIGS. 4–11 illustrate eight separate door configurations, each door having two door latch openers thereon in varying orientations.
Figure 5:
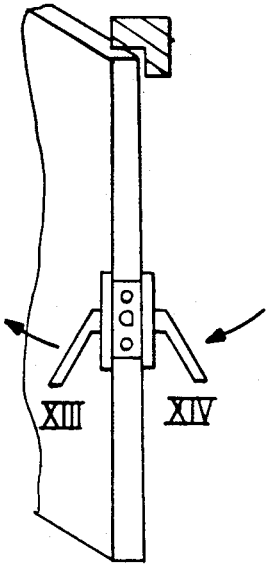
Figure 6:
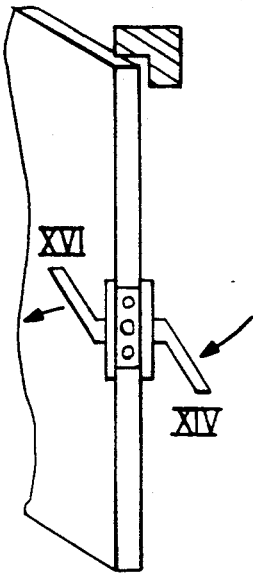
Figure 7:
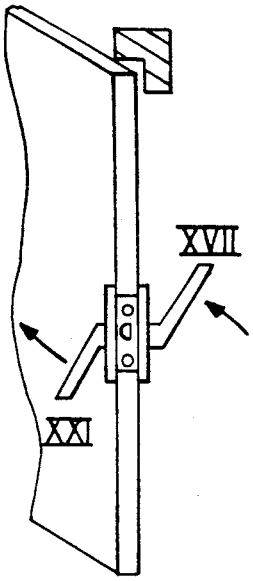
Figure 8:
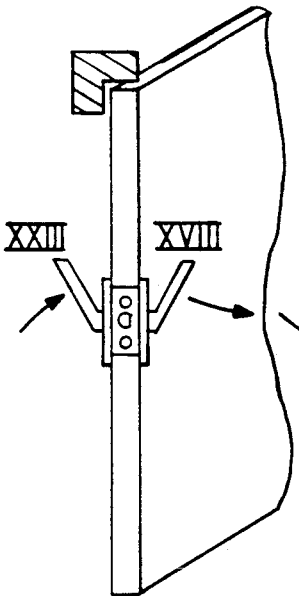
Figure 9:
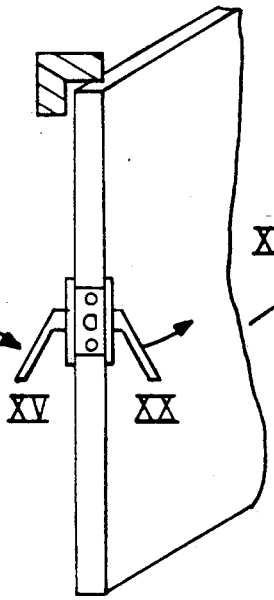
Figure 10:
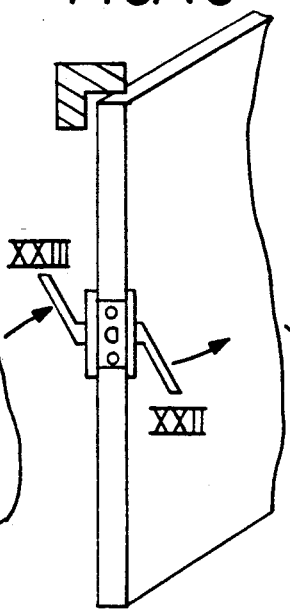

For example, FIG. 4 shows a right hand mounted door with a door latch opener on the left side designated by XII and a door latch opener on the right side designated by XVII. Door latch opener XII has a handle 18 in an upwardly extending orientation which must be pulled in order to unlock the door. Door latch opener XVII has an upwardly extending handle 18 which must be pushed in order to open the door. A portion of a door stop 82 is illustrated to show the direction in which the door would open. Generally, of course, the handle 18 would be pulled or pushed in the opening direction of the door in order to unlock the door latch. The door latch opener of the present invention could also be configured to move the handle opposite of the opening direction of the door to unlock the door latch if that were desireable in a special circumstance.

The arrangement of the handle 18 and actuator 22 required for door latch opening configuration XII is shown in FIG. 12. In such a configuration, the pivot pin 30 for the handle 18 is located in the offset openings 40, 42 and with the offset openings being arranged below the centered openings 32, 34. The actuator 22 is mounted such that the actuator will pivot to the right in the orientation shown in FIG. 12 upon a pulling downwardly of the handle 18.

Figure 17:
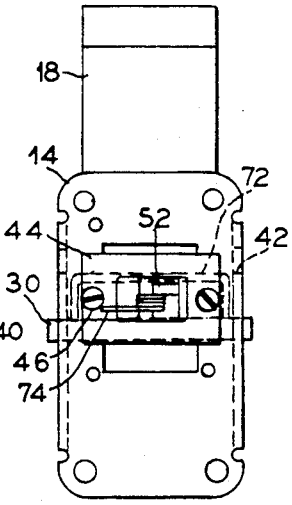
Figure 18:
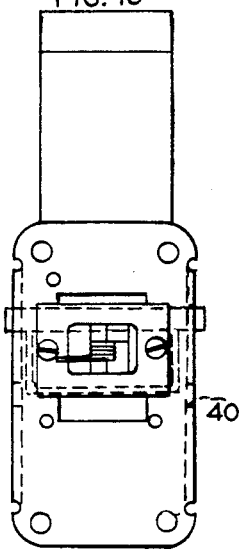
Figure 19:
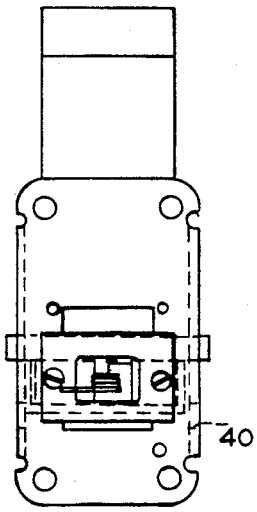
Figure 20:
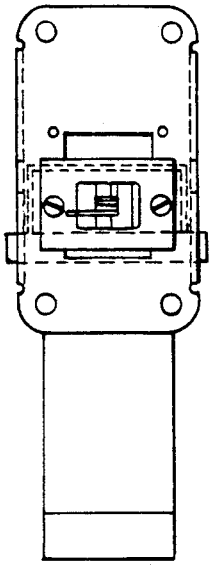
Figure 21:
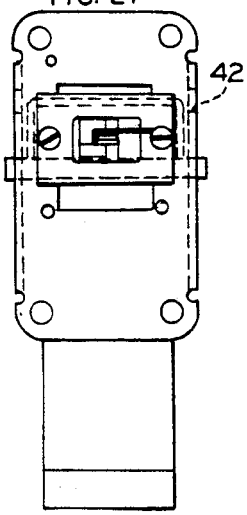
Figure 22:
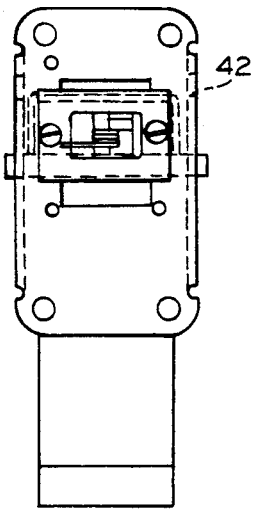
Figure 23:
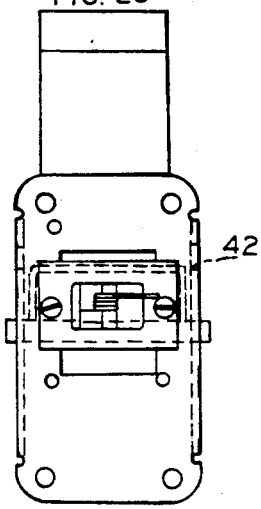

Door latch opener configuration XVII is shown in FIG. 17 wherein the handle pivot pin 30 is located in the center openings 32, 34 with the handle 18 projecting upwardly. The actuator 22 is arranged so as to move to the left in the orientation of FIG. 17 when the handle 18 is pushed. It is seen that the actuator arm 52 in FIG. 12 projects out of a bottom portion of the opening in the actuator plate 44 and the arm 52 in the orientation of FIG. 17 projects out of the top of the opening. Thus, the actuator arms will be free from interference.

Figure 11:
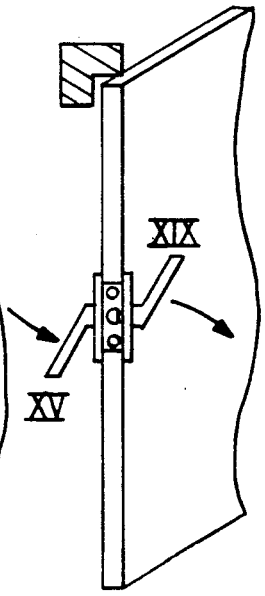

Each of the remaining door latch opener configurations illustrated in FIGS. 5–11 are shown in FIGS. 13–23 as indicated. It should be noted that where both handles extend in the same orientation, that is if both handles extend upwardly or both handles extend downwardly, then the handle which is pulled to unlock the door must have its pivot pin 30 positioned in the offset pair of openings 40, 42. All other handle orientations utilize the centered openings 32, 34. It should also be noted that the orientation of FIG. 11 is also that shown in FIG. 1. Further, the rotation of the actuator 12 will always be in the direction of the exposed end of the spring 74. The orientations of the base plate can be determined by whether the offset openings 40, 42 are "above" or "below" the centered openings 32, 34. The position of the spring 72 is also indicated which may be reversed depending on whether the handle is to be pulled or pushed to unlock the door.

Thus it is seen that the mounting plate 14, the handle 18, the actuator 22 and the spring 72 are each reversible to accommodate all of the possible combinations of door opener configurations thus permitting the manufacture of a single door opener mechanism which can be utilized as described.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A door latch opener comprising:

a base plate having a central opening and a pair of upstanding side walls, said side walls having two pairs of laterally aligned openings therethrough;

a handle reversibly mounted by means of a pivot pin, extending through a selected one of said two pairs of openings in said side walls on said base plate, to pivot about a first axis;

an actuator mounted by means of a pivot pin, carried on a pivot plate member, the pivot plate member being reversibly mounted on said base plate, to pivot about a second axis perpendicular to said first axis;

said handle having projections extending oppositely perpendicular from said first axis generally parallel to said second axis, a first of said projections being engageable with said actuator when said handle is pivotally mounted in a first orientation relative to said base plate and a second of said projections being engageable with said actuator when said handle is pivotally mounted in an opposite orientation relative to said base plate.

2. A door latch opener according to claim 1, further comprising a biasing means for urging said handle in a direction wherein said projection engaging said actuator moves away from said actuator.

3. A door latch opener according to claim 2, wherein said biasing means comprises a coil spring carried on a pivot pin aligned along said first axis.

4. A door latch opener according to claim 2, further comprising a biasing means for urging said actuator in a direction wherein said actuator moves toward said projection engaging said actuator.

5. A door latch opener according to claim 1, wherein said handle includes a manually engageable portion projecting perpendicularly away from said pivoting axis of said handle.

6. A pair of door latch openers to be mounted on opposite sides of a door to be used in cooperating relationship to move a single latch bolt between a locked and an unlocked position, said door latch openers having identical parts and each comprising:

a base plate with means thereon for securing said base plate to said door;

a handle having a manually engageable portion mounted on said base plate to pivot about a first axis in response to a selected one of pushing and pulling on said manually engageable portion;

an actuator mounted on said base plate to pivot about a second axis perpendicular to said first axis in response to pivoting of said handle and having a portion extending into said latch bolt;

said handle having oppositely extending projections, a first of said projections being engageable with said actuator when said handle is pivotally mounted in a first orientation relative to said base plate and a second of said projections being engageable with said actuator when said handle is pivotally mounted in an opposite orientation relative to said base plate.

7. A door latch opener according to claim 6, further comprising a biasing means for urging said handle in a direction wherein said projection engaging said actuator moves away from said actuator.

8. A door latch opener according to claim 7, wherein said biasing means comprises a coil spring carried on a pivot pin aligned along said first axis.

9. A door latch opener according to claim 7, further comprising a biasing means for urging said actuator in a direction wherein said actuator moves toward said projection engaging said actuator.

10. A door latch opener according to claim 6, wherein said handle includes a manually engageable portion projecting perpendicularly away from said pivoting axis of said handle.

11. A door latch opener comprising:

a base plate having upstanding wall means, said wall means having two pairs of laterally aligned openings therethrough;

a handle reversibly mounted by pivot means extending through a selected one of said two pairs of openings in said wall means on said base plate, to pivot about a first axis;

an actuator pivotally carried on a pivot plate member, to pivot about a second axis perpendicular to said first axis, the pivot plate member being reversibly mounted on said base plate;

said handle having projections extending oppositely perpendicular from said first axis and generally parallel to said second axis, a first of said projections being engageable with said actuator when said handle is pivotally mounted in a first orientation relative to said base plate and a said actuator when said handle is pivotally mounted in an opposite orientation relative to said base plate:

12. A door latch opener according to claim 11, further comprising a biasing means for urging said handle in a direction wherein said projection engaging said actuator moves away from said actuator.

13. A door latch opener according to claim 11, wherein said biasing means comprises a coil spring carried on a pivot pin aligned along said first axis.

14. A door latch opener according to claim 12, further comprising a biasing means for urging said actuator in a direction wherein said actuator moves toward said projection engaging said actuator.

15. A door latch opener according to claim 11, wherein said handle includes a manually engageable portion projecting perpendicularly away from said pivoting axis of said handle.

16. A door latch opener comprising:

a base plate having upstanding wall means, said wall means having laterally aligned openings therethrough;

a handle reversibly mounted by pivot means extending through said openings in said wall means on said base plate, to pivot about a first axis;

an actuator pivotally carried on a pivot plate member, to pivot about a second axis perpendicular to said first axis, the pivot plate member being reversibly mounted on said base plate;

said handle having projections extending oppositely perpendicular from said first axis and generally parallel to said second axis, a first of said projections being engageable with said actuator when said handle is pivotally mounted in a first orientation relative to said base plate and a second of said projections being engageable with said actuator when said handle is pivotally mounted in an opposite orientation relative to said base plate.

17. A door latch opener according to claim 16, further comprising a biasing means for urging said handle in a direction wherein said projection engaging said actuator moves away from said actuator.

18. A door latch opener according to claim 16, wherein said biasing means comprises a coil spring carried on a pivot pin aligned along said first axis.

19. A door latch opener according to claim 16, further comprising a biasing means for urging said actuator in a direction wherein said actuator moves toward said projection engaging said actuator.

20. A door latch opener according to claim 16, wherein said handle includes a manually engageable portion projecting perpendicularly away from said pivoting axis of said handle.

* * * * *